US005084653A

United States Patent [19]

Nilssen

[11] Patent Number: 5,084,653

[45] Date of Patent: Jan. 28, 1992

[54] POWER-LINE-ISOLATED DIMMABLE ELECTRONIC BALLAST

[76] Inventor: Ole K. Nilssen, Caesar Dr., Barrington, Ill. 60010

[21] Appl. No.: 704,919

[22] Filed: May 22, 1991

Related U.S. Application Data

[63] Continuation of Ser. No. 553,819, Jul. 18, 1990, abandoned.

[51] Int. Cl.[5] ..... H05B 41/29

[52] U.S. Cl. ..... 315/219; 315/220; 315/224; 315/282; 315/307; 315/324; 315/DIG. 7

[58] Field of Search ..... 315/209 R, 219, 220, 315/324, DIG. 7, 282, 205, 307, 224

[56] References Cited

U.S. PATENT DOCUMENTS 4,972,126 11/1990 Nilssen ..... 315/324

*Primary Examiner*—David Mis

[57] ABSTRACT

In an electronic ballast for powering three series-connected fluorescent lamps with a 30 kHz lamp current, a half-bridge series-resonance-type inverter circuit is powered from a substantially constant-magnitude DC supply voltage derived from ordinary 60 Hz power line voltage by way of a bridge rectifier and a single-transistor DC-to-DC converter using an energy-storing inductor with an isolated secondary winding from which the DC supply voltage is derived. Thus, the DC supply voltage is electrically isolated from the power line, as is also the inverter circuit itself as well as the ballast's output terminals. Lamp dimming is accomplished via a dimming control directly connected with the inverter circuit.

18 Claims, 2 Drawing Sheets

POWER-LINE-ISOLATED DIMMABLE ELECTRONIC BALLAST

BACKGROUND OF THE INVENTION

This application is a continuation of application Ser. No. 07/553,819 filed Jul. 18, 1990, now abandoned.

1. Field of the Invention

The present invention relates to power-line-operated electronic ballasts for gas discharge lamps, particularly of a kind that provides for control of light output via power-line-isolated control means.

2. Comments re Prior Art

A power-line-operated electronic ballast usually includes an inverter circuit operative to provide a high-frequency current to a set of gas discharge lamps. To provide protection against possible electric shock hazard, the output of the inverter circuis is usually supplied to the gas discharge lamps by way of an isolation transformer, thereby providing for electrical isolation between the ballast output terminals and the inverter circuit itself. This electrical isolation serves to provide electric shock protection for the person servicing the gas discharge lamps powered by the ballast.

SUMMARY OF THE INVENTION

Objects of the Invention

An object of the present invention is that of providing for an improved power-line-operated electronic ballast for gas discharge lamps.

This as well as other objects, features and advantages of the present invention will become apparent from the following description and claims.

Brief Description

In an electronic ballast for powering three series-connected fluorescent lamps with a 30 kHz lamp current, a half-bridge series-resonance-type inverter circuit is powered from a substantially constant-magnitude DC supply voltage derived from ordinary 60 Hz power line voltage by way of a bridge rectifier and a single-transistor DC-to-DC converter using an energy-storing inductor with an isolated secondary winding from which the DC supply voltage is derived.

Thus, the inverter circuit's DC supply voltage is electrically isolated from the power line; which means that the inverter circuit itself as well as the ballast's output terminals are electrically isolated from the power line.

Lamp dimming is accomplished via a dimming control directly connected with the inverter circuit; which implies that the dimming control is also electrically isolated from the power line.

In other words, by way of providing power line isolation at a point between the power line and the inverter circuit, rather than at the inverter circuit's output, the electronic ballast herein disclosed provides for electric shock hazard protection both with respect to its power output as well as with respect to its dimming control input. That is, a single electrical isolation means provides power line isolation both for the ballast's power output terminals as well as for the ballast's dimming control input terminals.

Otherwise, subject electronic ballast includes a half-bridge inverter connected with the constant-magnitude DC supply voltage and operative to provide a 30 kHz squarewave output voltage across a series-connected L-C circuit that is resonant at or near the frequency of the 30 kHz squarewave output voltage.

The L-C circuit has a tank inductor and a tank capacitor. The tank capacitor and the tank inductor are connected together at a center-point. The tank capacitor is connected between this center point and an inverter center-tap. The tank inductor has an auxiliary secondary winding, whose terminals are connected between the inverter center-tap and an auxiliary terminal. The three series-connected fluorescent lamps are connected between the center-point and the auxiliary terminal.

Thus, the voltage provided across the fluorescent lamps is the sum of the substantially sinusoidal voltage present across the tank capacitor and the non-sinusoidal voltage present across the output terminals of the auxiliary winding. By making the RMS magnitude of the voltage provided from the auxiliary winding equal to about one half of the RMS magnitude of the voltage present across the tank capacitor, and by providing for the proper phasing of the auxiliary winding's terminals, the net magnitude of the RMS voltage across the three series-connected fluorescent lamps will be about fifty percent higher than the RMS magnitude of the voltage present across the tank capacitor; thereby, without resorting to excessive Q-multiplication (which would result in decreased efficiency), providing adequate lamp starting and operating voltage without incurring objectionable increase of lamp current crest factor.

The ballast's series-resonant inverter is controlled by adjustment of the symmetry of the inverter's squarewave (or rectangular-wave) output voltage as a function of the magnitude of the inverter's output current. The ballast's DC-to-DC converter is driven via a saturable current transformer by current from the series-resonant inverter; and its operation is controlled by way of adjusting the single transistor's ON-time as a function of the magnitude of the DC supply voltage.

An important feature of subject ballast is that, with only minor modifications to the DC-to-DC converter, the magnitude of the DC supply voltage can be made to stay constant regardless of major differences in the magnitude of the power line voltage. Thus, the ballast-s'inverter circuit can be identically the same whether the ballast is designed to be powered from a 120 Volt/60 Hz power line or a 277/60 Hz Volt power line.

DESCRIPTION OF THE PREFERRED EMBODIMENT

Details of Construction

Figure 1:
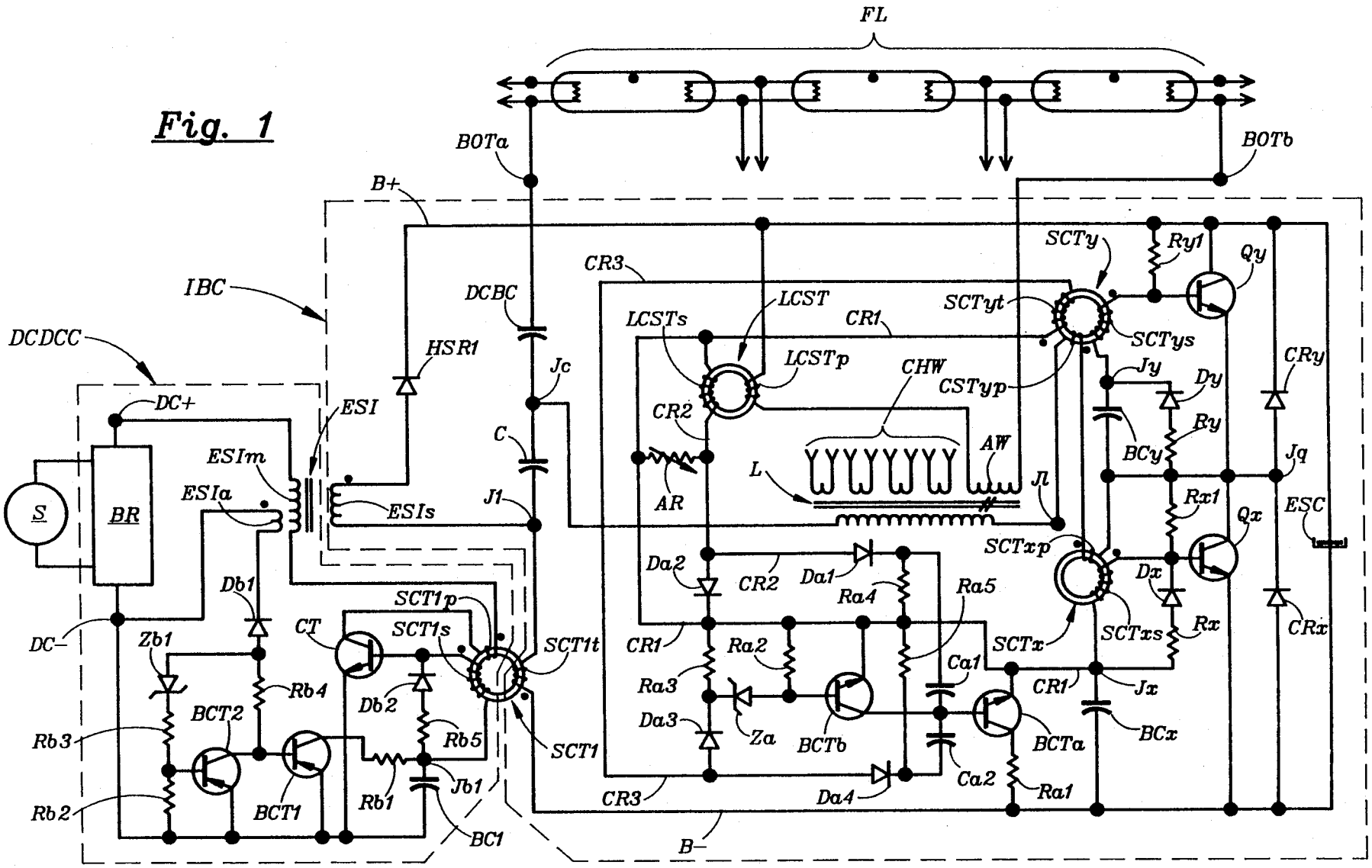
FIG. 1 is a schematic circuit diagram of the preferred embodiment of the invention.

In FIG. 1, a source S of 120 Volt/60 Hz voltage is applied to a full-wave bridge rectifier BR, the unfiltered unidirectional voltage output of which is applied directly between a DC+terminal and a DC− terminal; with the positive voltage being connected to the DC+ terminal.

The main winding ESIm of energy-storing inductor ESI is connected in series with a primary winding SCT1p of saturable current transformer SCT1 to form a series-combination; which series-combination is connected between the DC+ terminal and the collector of a converter transistor CT, whose emitter is connected with the DC− terminal.

A secondary winding SCT1s on transformer SCT1 is connected between the base of transistor CT and a junction Jb1. A diode Db2 is connected with its cathode to the base of transistor CT; whose anode is connected with junction Jb1 via a resistor Rb5. A bias capacitor BC1 is connected between junction Jb1 and the DC− terminal. A resistor Rb1 is connected between junction Jb1 and the collector of bias control transistor BCT1, whose emitter is connected with the DC− terminal.

The base of transistor BCT1 is connected with the collector of a bias control transistor BCT2, whose emitter is connected with the DC− terminal. A resistor Rb2 is connected between the base of transistor BCT2 and the DC− terminal; and a resistor Rb3 is connected between the base of transistor BCT2 and the cathode of a Zener diode Zb1, whose anode is connected with the anode of a diode Db1. A resistor Rb4 is connected between the anode of diode Db1 and the base of transistor BCT1. The cathode of diode Db1 is connected with the DC− terminal by way of an auxiliary winding ESIa on energy-storing inductor ESI.

Except for power line source S, all the elements identified hereinabove are, in combination, referred-to as DCDCC.

A secondary winding ESIs on energy-storing inductor ESI is connected between a junction J1 and the anode of a high-speed rectifier HSR1, whose cathode is connected with a B+ bus.

A tertiary winding SCT1t of saturable current transformer SCT1 is connected between junction J1 and a B- bus.

An energy-storing capacitor ESC is connected between the B− bus and the B+ bus.

A first commutating rectifier CRx is connected with its anode to the B− bus and with its cathode to a junction Jq; a second commutating rectifier CRy is connected with its anode to junction Jq and with its cathode to the B+ bus. A first inverter transistor Qx is connected with its emitter to the B− bus and with its collector to junction Jq; a second inverter transistor Qy is connected with its emitter to junction Jq and with its collector to the B+ bus.

The secondary winding SCTxs of a first saturable current transformer SCTx is connected between the base of transistor Qx and a junction Jx. A first bias capacitor BCx is connected between junction Jx and the B− bus. A diode Dx is connected with its cathode to the base of transistor Qx. A resistor Rx is connected between junction Jx and the anode of diode Dx. A resistor Rx1 is connected between junction Jq and the base of transistor Qx.

The secondary winding SCTys of a second saturable current transformer SCTy is connected between the base of transistor Qy and a junction Jy. A second bias capacitor BCy is connected between junction Jy and junction Jq. A diode Dy is connected with its cathode to junction Jy. A resistor Ry is connected between junction Jq and the anode of diode Dy. A resistor Ry1 is connected between the B+ bus and the base of transistor Qy.

Primary winding SCTxp of transformer SCTx is series-connected with primary winding SCTyp of transformer SCTy to form a series-combination; which series-combination is connected between junction Jq and a junction J1.

A tank inductor L is connected between junction J1 and a junction Jc; and a tank capacitor C is connected between junctions Jc and J1. A DC and low-frequency blocking capacitor DCBC is connected between junction Jc and ballast output terminal BOTa. An auxiliary winding AW is wound on tank inductor L and is relatively loosely coupled thereto. This auxiliary winding is connected with one of its terminals to ballast output terminal BOTb and with the other one of its terminals to the B+ bus via primary winding LCSTp of lamp current sensing transformer LCST.

Three fluorescent lamps FL are series-connected between ballast output terminals BOTa and BOTb; which fluorescent lamps have four pairs of cathode heater terminals; each pair being connected with the terminals of one of four cathode heater windings CHW wound as secondary windings on tank inductor L.

An adjustable resistor AR and a secondary winding LCSTs on transformer LCST are both connected between conductor rails CR1 and CR2; conductor rail CR1 being connected with junction Jx. A tertiary winding SCTyt on transformer SCTy is connected between first conductor rail CR1 and a third conductor rail CR3.

A bias control transistor BCTa is connected with its emitter to conductor rail CR1 and, via a resistor Ra1, with its collector to the B− bus. The collector of a bias control transistor BCTb is connected with the base of transistor BCTa and with its emitter to conductor rail CR1.

A resistor Ra2 is connected between the base of transistor BCTb and conductor rail CR1; a resistor Ra3 is connected between the cathode of diode Da3 and conductor rail CR1; a resistor Ra4 is connected between the cathode of diode Dal and conductor rail CR1; and a resistor Ra5 is connected between the cathode of diode Da4 and conductor rail CR1.

The anode of a diode Dal is connected with conductor rail CR2. A capacitor Cal is connected between the cathode of diode Da1 and the base of transistor BCTa. The anode of a diode Da2 is connected with conductor rail CR2. A Zener diode Za is connected with its cathode to the cathode of diode Da2 and with its anode to the base of transistor BCTb.

A diode Da3 is connected with its cathode to the cathode of Zener diode Zb and with its anode to conductor rail CR3. The anode of a diode Da4 is connected with conductor rail CR3. A capacitor Ca2 is connected between the cathode of diode Da4 and the base of transistor BCTa.

The combination of all the elements of FIG. 1, except for power line source S, DC-to-DC converter DCDCC and fluorescent lamps FL, is referred-to as inverter ballast circuit IBC.

Details of Operation

Figure 2:
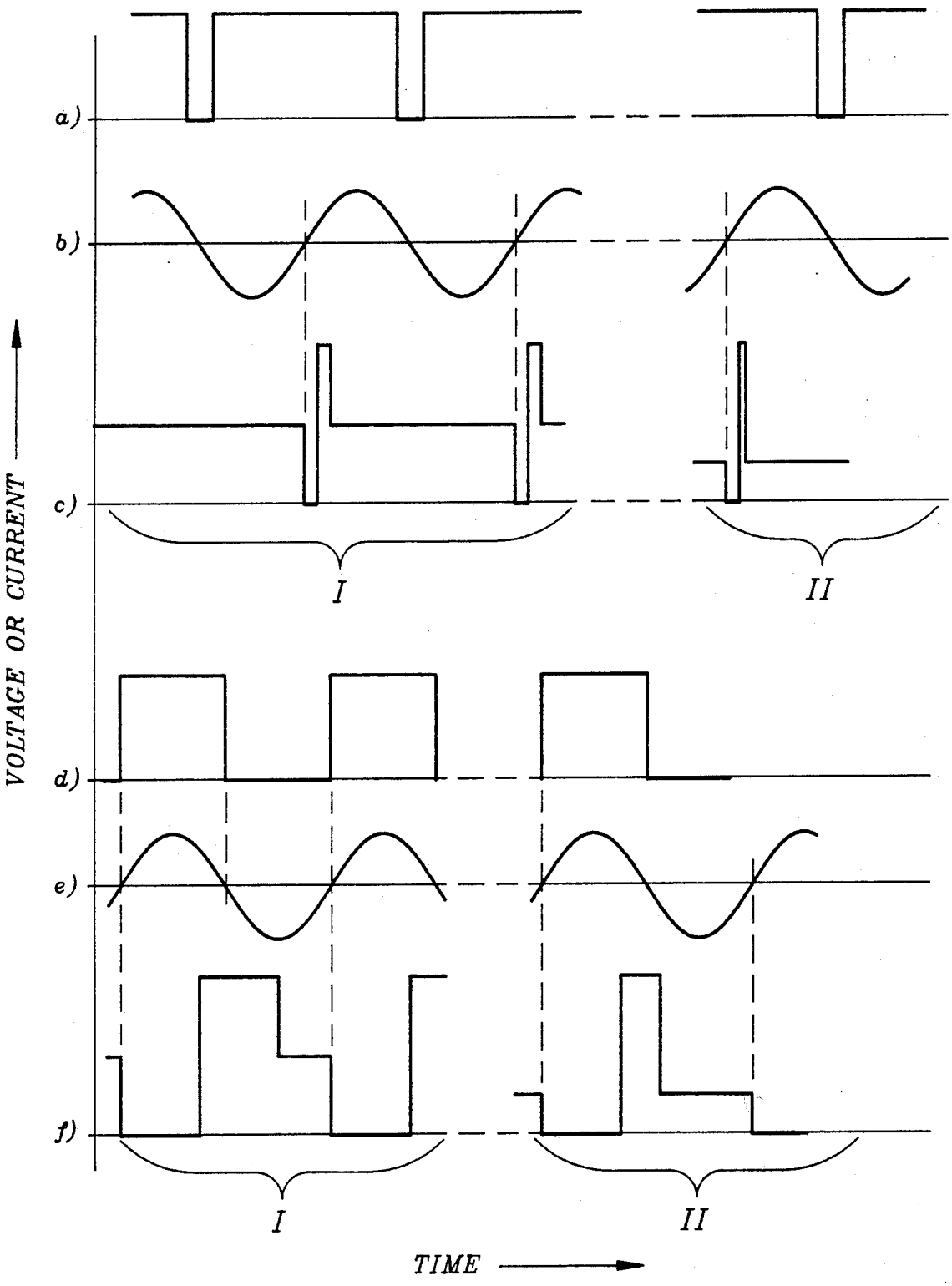
FIG. 2 shows various voltage and current waveforms associated with the preferred embodiment of FIG. 1.

The operation of the ballast of FIG. 1 may best be understood when analyzed in view of the various voltage and current waveforms of FIG. 2; which waveforms are approximate as well as somewhat idealized.

FIG. 2*a* shows the voltage at junction Jq (i.e., at the collector of transistor Qx), as viewed with respect to the B− bus (i.e., the emitter of transistor Qx), under a condition when there is substantially no loading of the series-resonant L-C circuit consisting of tank-inductor L and tank-capacitor C.

FIG. 2*b* shows the substantially sinusoidal current flowing from the inverter's output (i.e., from junction Jq or, rather, between junctions Jq and J1) and through tank-inductor L under the condition when there is substantially no loading of the series-resonant L-C circuit.

FIG. 2*c* shows the voltage at the collector of converter transistor CT, as viewed with respect to its emitter (i.e., with respect to the DC− terminal), under the condition when there is substantially no loading of the series-resonant L-C circuit. FIG. 2*c* is divided into two parts: Part I represents the situation where the instantaneous absolute magnitude of the power line voltage (i.e., the voltage from source S) is at or near its maximum value; Part II represents the situation where the instantaneous absolute magnitude of the power line voltage equals about half of its maximum value.

FIG. 2*d* shows the voltage at junction Jq, as viewed with respect to the B− bus, under a condition when there is substantially full loading of the series-resonant L-C circuit.

FIG. 2*e* shows the substantially sinusoidal current flowing from the inverter's output and through tank inductor L under a condition when there is substantially full loading of the series-resonant L-C circuit.

FIG. 2*f* shows the voltage at the collector of converter transistor CT, as viewed with respect to its emitter, under the condition when there is substantially full loading of the series-resonant L-C circuit. FIG. 2*f* is divided into two parts: Part I represents the situation where the instantaneous absolute magnitude of the power line voltage is at or near its maximum value; Part II represents the situation where the instantaneous absolute magnitude of the power line voltage equals about half of its maximum value.

In its main aspects, the operation of inverter ballast circuit IBC of FIG. 1 is substantially the same as that of the inverter ballast circuit described in U.S. Pat. No. 4,939,427 to Nilssen. The key differences are as follows:

(1) The auxiliary winding (AW) added onto the tank-inductor (L) provides for an increased RMS magnitude of the high-frequency voltage provided between ballast output terminals BOTa and BOTb, thereby attaining such increased output voltage magnitude without having to resort to additional Q-multiplication in the series-resonant L-C circuit; which additional Q-multiplication would have required higher magnitude inverter output current and would have caused increased circuit losses;

(2) Rather than a center-tapped pair of energy-storing capacitors, instant inverter circuit uses a single energy-storing capacitor (i.e., capacitor ESC);

(3) Rather than being connected with the center-tap between two energy-storing capacitors, the tank capacitor (i.e., capacitor C) is connected to the B− bus;

(4) By way of DC blocking capacitor DCBC, unidirectional current is now manifestly prevented from flowing through the fluorescent lamps; and (5) Control of the inverter's operation is accomplished in a different manner, as described in more complete detail hereinbelow.

Inverter ballast circuit IBC is controlled by way of controlling the magnitude of the reverse bias voltage at junctions Jx and Jy: the larger be the magnitude of the reverse bias voltage at junction Jx, the shorter be the duration of the ON-time of transistor Qx; the larger be the magnitude of the reverse bias voltage at junction Jy, the shorter be the duration of the ON-time of transistor Qy.

The magnitude of the reverse bias voltage at junction Jy is mainly determined by the resistance of resistor Ry combined with the magnitude of the base current flowing into the base of transistor Qy; which magnitude, by virtue of the fixed turns-ratio of current transformer SCTy, is directly proportional to the magnitude of the current flowing through transistor Qy.

Thus, the higher the magnitude of the current flowing through transistor Qy, the larger the magnitude of the reverse bias voltage at junction Jy. That is, an increase in the magnitude of the current flowing through transistor Qy causes a shortening of the duration of the ON-time of transistor Qy; which, in turn, causes a reduction in the magnitude of the current flowing through transistor Qy; etc.

In other words, the combination of diode Dy and resistor Ry provides for a negative feedback function operative to cause the magnitude of the inverter's output current to tend to remain constant as various factors might otherwise cause it to change.

The magnitude of the reverse bias voltage at junction Jx is mainly determined by the state of conduction of bias control transistor BCTa; whose state of conduction is, in turn, determined by the state of conduction of bias control transistor BCTb. That is: when transistor BCTb conducts, transistor BCTa is prevented from conducting.

With the fluorescent lamps non-connected, no current flows through primary winding LCSTp of lamp current sensing transformer LCST; which means that no voltage will exist between conductor rail CR1 and CR2. Thus, with the lamps non-connected, input to the base of transistor BCTa can only come from conductor rail CR3.

Voltage to conductor rail CR3 is provided by the 30 kHz periodic re-setting of the saturable ferrite core of saturable current transformer SCTy; which re-setting is accomplished by the substantially sinusoidal current flowing through primary winding SCTyp (see FIG. 2*b*). The magnitude of this voltage is determined in substantial part by the magnitude of the resistance of resistor Ra3.

Once each cycle of the periodic voltage provided at conductor rail CR3, a pulse of current is delivered via capacitor Ca2 to the base of transistor BCTa. The duration of this current pulse is determined by the resistance of resistor Ra5, whose function is that of discharging capacitor Ca2 between each current pulse. Without resistor Ra5, capacitor Ca2 would simply charge up to a maximum level via the base-emitter junction of transistor BCTa; and after that point, no further current pulses would be provided to the base of transistor BCTa. By providing for a suitable amount of charge-leakage via resistor Ra5, the width of the current pulses provided to the base of transistor BCTa can be made to have a desired duration.

Each time a current pulse is provided at its base, transistor BCTa becomes conductive, thereby causing positive charge to leak to bias capacitor BCx, thereby reducing the magnitude of the negative bias voltage at junction Jx. The amount of charge leakage will be determined by the duration of the base current pulse as well as by the resistance value of resistor Ra1. Under stable operation, the amount of positive charge leaked away via transistor BCTa must equal the amount of negative charge pulled away from bias capacitor BCx via the base-emitter junction of transistor Qx.

As the magnitude of the inverter's output current increases, the magnitude of the re-set current provided from tertiary winding SCTyt to conductor rail CR3 increases correspondingly, as does the magnitude of the resulting voltage pulses provided at this conductor rail CR3. Eventually, the magnitude of these voltage pulses will become high enough to cause Zener diode Za to conduct. When that occurs, transistor BCTb receives base current pulses and is therefore caused to conduct each time transistor BCTa conducts; thereby, in turn, reducing the time during which transistor BCTa conducts; thereby, in turn, reducing the leakage of positive charge from bias capacitor BCx. Thus, the magnitude of the inverter's output current is prevented from rising much past the point at which Zener diode Za starts to conduct; which, as long as the fluorescent lamps remain non-connected, is equivalent to preventing the magnitude of the high-frequency voltage developing across tank capacitor C from exceeding a certain level; which level directly corresponds to the maximum permitted inverter output current.

In other words, with the fluorescent lamps non-connected, the action of transistors BCTa and CBTb together with their associated components is, by controlling the magnitude of the negative bias voltage on bias capacitor BCx, operative to control the magnitude of the inverter output current and to prevent it from exceeding some pre-determined level. Absent this control, the magnitude of the inverter's output current would rise to a level high enough to cause component damage or even inverter self-destruction.

In fact, in the preferred embodiment of the present invention, the magnitude of the inverter's output current is controlled such as to cause the RMS magnitude of the open circuit ballast output voltage (i.e., the high-frequency voltage existing between ballast output terminals BOTa and BOTb) to be just sufficient to cause the fluorescent lamps to ignite.

Another way of looking at the control action, as performed by the control circuit consisting of bias control transistors BCTa and BCTb and their associated components, is that of recognizing that the current pulses provided to the base of transistor BCTa provides for a positive feedback effect that is operative to cause the magnitude of the inverter's output current to increase; while the current pulses provided to the base of transistor BCTb provides for an over-riding negative feedback effect. Thus, after the magnitude of the inverter's output current has increased to the point where current pulses will be provided to the base of transistor BCTb, a high degree of negative feedback occurs; thereby preventing the magnitude of the inverter's output current from increasing further.

After the lamps have ignited, the resulting high-frequency lamp current flows through primary winding LCSTp of lamp current sensing transformer LCST, thereby causing a high-frequency current of proportional magnitude to flow through adjustable resistor AR. A corresponding high-frequency voltage develops across resistor AR, and this high-frequency voltage is applied between conductor rails CR1 and CR2.

The presence of this lamp-current-magnitude-proportional high-frequency voltage between conductor rails CR1 and CR2 now causes additional current pulses to be applied to the base of transistor BCTa, thereby providing for additional positive charge leakage from bias capacitor BCx; which additional charge leakage provides for a higher-magnitude lamp current; thereby causing yet more charge leakage; etc.

Thus, as soon as some lamp current starts flowing, the above-indicated positive feedback effect occurs; which positive feedback effect causes the magnitude of the lamp current to increase. However, eventually the magnitude of the lamp-current-magnitude-proportional high-frequency voltage between conductor rails CR1 and CR2 becomes high enough to cause Zener diode Za to conduct; whereafter a negative feedback effect takes place; which negative feedback effect is operative to dominate the positive feedback effect and therefore to prevent the magnitude of the lamp current from exceeding a level determined by the combined effect of the Zener voltage of Zener diode Za and the resistance value of adjustable resistor AR. That is, for a given Zener voltage, the lamp current magnitude will adjust itself to a level that is approximately inversely proportional to the resistance value of adjustable resistor AR.

Thus, adjusting the resistance value of adjustable resistor AR provides for corresponding adjustment of the magnitude of the lamp current; which is to say that adjustable resistor AR permits lamp dimming.

With reference to the waveforms of FIG. 2, the operation of DC− to-DC converter DCDCC of FIG. 1 is explained as follows.

The 30 kHz current through tank capacitor C—which is illustrated in FIG. 2*b* and FIG. 2*e*—flows through primary winding SCT1p of saturable current transformer SCT1; thereby providing base current to converter transistor CT; thereby causing transistor CT to become conductive. Once transistor CT enters its conductive (or ON−) state, collector current starts to flow; which collector current flows through main winding ESIm of energy-storing inductor ESI as well as through primary winding SCT1p of saturable current transformer SCT1. This collector current will, by way of positive feedback via transformer SCT1, provide for additional current to the base of transistor CT; thereby re-inforcing its ON-state; which ON-state will last until transformer SCT1 saturates; after which point transistor CT enters its OFF-state; thereby ending the flow of current through main winding ESIm; thereby, in turn, causing the magnetization current of energy-storing inductor ESI to continue its flow via its secondary winding ESIs; thereby, via high-speed rectifier HSR1, discharging the energy stored in energy-storing inductor ESI into energy-storing capacitor ESC.

For a given magnitude of DC voltage between the DC− terminal and the DC+ terminal, and for a given magnitude of the reverse bias voltage on bias capacitor BC1, the magnitude to which the current through the main winding of energy-storing inductor ESI grows is proportional to the duration of the ON-state of transistor CT; which means that the amount of energy being stored in energy-storing inductor ESI is proportional to the square of the duration of this ON-state; which, as long as the frequency of the triggering current flowing through tertiary winding SCT1t is constant, means that the power transferred from DC− to-DC converter DCDCC to energy-storing capacitor ESC is proportional to the duration of the ON-state of transistor CT; which is to say that the power transferred to energy-storing capacitor ESC is roughly inversely proportional to the magnitude of the reverse bias voltage on bias capacitor BC1.

That is, the duration of the ON-state of transistor CT is determined by the magnitude of the reverse (or negative) bias on bias capacitor BC1: this duration getting shorter as the magnitude of the reverse bias increases. In turn, the magnitude of the reverse bias keeps increasing each time base current is provided to the base of transistor CT; which implies that the magnitude of this reverse bias will keep on increasing except to the degree that charge may be leaked to the bias capacitor via bias control transistor BCT1.

In other words, except to the degree that a charge leakage path is provided through transistor BCT1, the amount of power transferred to energy-storing capacitor ESC via DC− to-DC converter DCDCC will gradually choke itself off and become negligible. The time it takes for this choking-off effect to take place depends on the capacitance value of bias capacitor BC1; which capacitance value is so chosen that it takes but a few milli-seconds for this choking-off to occur.

However, except if the magnitude of the DC voltage between the B− bus and the B+ bus were to exceed some pre-established level, a charge leakage path through transistor BCT1 is indeed provided-for by way of supplying current pulses to the base of transistor BCT1; which current pulses are supplied from auxiliary winding ESIa on energy-storing inductor ESI via diode Db1 and resistor Rb4. Thus, each time the energy stored in energy-storing inductor ESI is discharged from its secondary winding ESIs, a negative voltage pulse is provided from auxiliary winding ESIa to the cathode of diode Db1; which negative voltage pulse results in a corresponding current pulse to the base of transistor BCT1; thereby causing transistor BCT1 to become conductive for as long as energy is indeed being discharged from secondary winding ESIs of energy-storing inductor ESI; which, in turn, means that the degree of charge leakage from bias capacitor BC1 will be roughly proportional to the amount of energy being supplied via energy-storing inductor ESI.

However, since the magnitude of the negative voltage pulses provided to the cathode of diode Db1 is directly proportional to that of the DC voltage present between the B− bus and the B+ bus (i.e., the DC voltage present across energy-storing capacitor ESC), if the magnitude of this DC voltage were to exceed a certain level, the magnitude of the negative voltage pulses provided at the cathode of diode Db1 will become so large as to cause Zener diode Zb1 to conduct; at which point transistor BCT2 starts to become conductive; thereby, in turn, shunting-away at least some of the base current provided to transistor BCT1; thereby, in turn, causing a reduction in the amount of charge leaked away from bias capacitor BC1 via transistor BCT1.

Thus, DC− to-DC converter DCDCC operates to pump energy at a certain rate into energy-storing capacitor ESC until the magnitude of the DC voltage across this energy-storing capacitor reaches a certain predetermined level; past which point the rate of energy-transfer will sharply diminish as the magnitude of this DC voltage increases but a small amount above this certain pre-established level.

Additional Comments (a) Under ordinary circumstances (such as when the three fluorescent lamps are fully powered), except for frequency components above 30 kHz, the waveshape of the current drawn from source S is such as to be nearly sinusoidal; which implies that the ballast of FIG. 1 draws power from the power line with an exceptionally high power factor and correspondingly low harmonic distortion.

(b) The ferrite core of saturable current transformer SCT1 is reset each alternate half-cycle of the tank-capacitor current that is fed through its tertiary (or trigger) winding SCT1t. The current resulting from the core reset process flows through diode Db2 and resistor Rb5, thereby not affecting the flow of charge to and/or from bias capacitor BC1.

(c) To minimize radio frequency interference (RFI) delivered by the ballast to the power line, as well as for improving power factor and minimizing harmonics in the current drawn from the power line, it is desirable to interpose an RFI and/or a low pass filter between the power line terminals and the DC−/DC+terminals. With such a filter in place, the flow of current from the power line will be substantially void of high frequency components and substantially sinusoidal in waveshape.

(d) Inverter ballast circuit IBC is electrically isolated from DC− to-DC converter DCDCC, and thereby also from the powerline source S. The purpose of this isolation is two-fold: (i) protection against electric shock hazard for the person installing and/or servicing the fluorescent lamps; and (ii) to permit the dimming control means (such as adjustable resistor AR) to be located remotely from the inverter ballast circuit without having to provide any further protection against electric shock hazard.

However, to effect the indicated protection against electric shock hazard, there is no need for the electrical isolation between inverter ballast circuit IBC and DC− to-DC converter DCDCC to be total: it only has to be sufficient to prevent any potential ground-fault current from exceeding what is considered a shock-safe magnitude; which shock-safe magnitude is in excess of 30 milli-Ampere at a frequency of 30 kHz or above.

To provide for easier lamp ignition, it is in fact desirable to provide for a small amount of leakage of 30 kHz current between inverter ballast circuit IBC and DC− to-DC converter DCDCC; which small amount of leakage is conveniently accomplished by way of connecting a small capacitor (not shown in FIG. 1) between the B+ bus and the ground-plane (not shown) of the lighting fixture (not shown) in which the fluorescent lamps are mounted.

(e) It is believed that the present invention and its several attendant advantages and features will be understood from the preceeding description. However, without departing from the spirit of the invention, changes may be made in its form and in the construction and/or interrelationships of its component parts, the form herein presented merely representing the currently preferred embodiment.

I claim:

1. An arrangement comprising:

a source providing an AC power line voltage at a pair of power line terminals;

rectifier means connected with the power line terminals and operative to provide a first DC voltage at a first set of DC terminals; the absolute instantaneous magnitude of the first DC voltage being substantially equal to that of the AC power line voltage;

DC-to-DC converter means connected with the first set of DC terminals and operative to provide a second DC voltage at a second set of DC terminals; the second set of DC terminals being electrically isolated from the power line terminals; the magnitude of the second DC voltage being approximately constant;

inverter ballasting means connected with the second set of DC terminals and operative to provide a current-limited high-frequency output voltage at a set of ballast output terminals; and gas discharge lamp means connected with the ballast output terminals and operative to be properly started and powered from the current-limited high-frequency output voltage provided thereat; the gas discharge lamp means being operative to provide luminous output.

2. The arrangement of claim 1 wherein: (i) the waveshape of the AC power line voltage is substantially sinusoidal; (ii) the rectifier means draws an alternating current from the power line terminals; and (iii) the waveshape of this alternating current is substantially sinusoidal.

3. The arrangement of claim 1 wherein the inverter ballasting means includes control means operative to permit control of the amount of luminous output; the control means being electrically isolated from the power line terminals.

4. The arrangement of claim 1 wherein the control means is connected with the inverter ballasting means without any intervening electrical isolation means.

5. The arrangement of claim 1 wherein: (i) the DC-to-DC converter means includes a transistor being alternatingly switched at a certain frequency between a state of conduction and a state of non-conduction; and (ii) this certain frequency is equal to the fundamental frequency of the high-frequency output voltage.

6. The arrangement of claim 1 wherein: (i) the inverter ballasting means includes a series-combination of a tank-capacitor and a tank-inductor; (ii) this series-combination is resonant at or near the fundamental frequency of the high-frequency output voltage; (iii) the tank-capacitor is connected with the tank-inductor at a tank junction; (iv) the tank-inductor includes an auxiliary winding that is connected in circuit between the tank junction and the ballast output terminals.

7. The arrangement of claim 1 wherein (i) the DC-to-DC converter means includes a transistor; (ii) this transistor has a set of control terminals to alternate between a state of conduction and a state of non-conduction; and (iii) the drive signal is provided from the inverter ballasting means and is synchronous with the high-frequency output voltage.

8. An arrangement comprising:

rectifier means operative to connect with a source of ordinary AC power line voltage and, when indeed so connected, to provide a first DC voltage at a first set of DC terminals; the absolute instantaneous magnitude of the first DC voltage being substantially equal to that of the AC power line voltage;

DC-to-DC converter means connected with the first set of DC terminals and operative to provide a second DC voltage at a second set of DC terminals; the magnitude of the second DC voltage being approximately constant; the DC-to-DC converter including a transistor alternating at a certain fundamental frequency between a state of conduction and a state on non-conduction; the certain fundamental frequency being substantially constant and independent of the instantaneous magnitude of the first DC voltage; and inverter ballasting means connected with the second set of DC terminals and operative to provide a current-limited high-frequency output voltage at a set of ballast output terminals.

9. The arrangement of claim 8 wherein: (i) said certain fundamental period has a duration; (ii) the state of conduction occupies a certain percentage of said duration; and (iii) said percentage remains substantially constant irrespective of the instantaneous magnitude of the first DC voltage.

10. The arrangement of claim 8 wherein (i) the waveshape of the AC power line voltage is substantially sinusoidal; (ii) the rectifier means draws an alternating current from the source; and (iii) the alternating current has a waveshape that is substantially sinusoidal.

11. An arrangement comprising:

rectifier means operative to connect with a source of ordinary AC power line voltage and, when indeed so connected, to provide a first DC voltage at a first set of DC terminals; the absolute instantaneous magnitude of the first DC voltage being substantially equal to that of the AC power line voltage;

DC-to-DC converter means connected with the first set of DC terminals and operative to provide a second DC voltage at a second set of DC terminals; the magnitude of the second DC voltage being approximately constant; the DC-to-DC converter including a transistor alternating, in response to receiving an alternating control voltage, at a certain fundamental frequency between a state of conduction and a state of nonconduction; and inverter ballasting means connected with the second set of DC terminals and operative to provide said alternating control voltage as well as a current-limited high-frequency output voltage at a set of ballast output terminals; the fundamental frequency of the high-frequency output voltage being equal to said certain fundamental frequency.

12. The arrangement of claim 11 wherein the fundamental frequency of the high-frequency output voltage is substantially the same regardless of the magnitude of any current being drawn from the ballast output terminals.

13. The arrangement of claim 11 wherein the inverter ballasting means is electrically isolated from the source, thereby providing protection against electric shock hazard associated with a person touching an item that is electrically connected with one of the ballast output terminals.

14. The arrangement of claim 11 wherein, if no current is being drawn from the ballast output terminals, substantially no current is being drawn from the source.

15. An arrangement comprising:

rectifier means connected with a source of ordinary AC power line voltage and operative to provide a first DC voltage at a first set of DC terminals; the absolute instantaneous magnitude of the first DC voltage being substantially equal to that of the AC power line voltage;

DC-to-DC converter means connected with the first set of DC terminals and operative to provide a second DC voltage at a second set of DC terminals; the magnitude of the second DC voltage being approximately constant; the DC-to-DC converter including a transistor having a control input and, when receiving an alternating control voltage at its control input, being operative to alternate at a certain fundamental frequency between a state of conduction and a state of non-conduction; and inverter ballasting means connected with the second set of DC terminals and operative, at least in part, to provide said alternating control voltage as well as a current-limited high-frequency output voltage at a set of ballast output terminals; the fundamental frequency of the high-frequency output voltage being equal to said certain fundamental frequency.

16. An arrangement comprising:

rectifier means connected with a source of ordinary AC power line voltage and operative to provide a first DC voltage at a first set of DC terminals;

DC-to-DC converter means connected with the first set of DC terminals and operative to provide a second DC voltage at a second set of DC terminals; the magnitude of the second DC voltage being approximately constant and higher than that of the first DC voltage; the DC-to-DC converter including a transistor having a control input at which it receives an alternating control voltage; the transistor being operative to alternate at a certain fundamental frequency between a state of conduction and a state of non-conduction; and inverter ballasting means connected with the second set of DC terminals and operative to provide said alternating control voltage as well as a current-limited high-frequency output voltage as a set of ballast output terminals; the fundamental frequency of the high-frequency output voltage being equal to said certain fundamental frequency.

17. An arrangement comprising:

a source providing an AC power line voltage at a pair of power line terminals;

rectifier means connected with the power line terminals and operative to provide a first DC voltage at a first set of DC terminals;

DC-to-DC converter means connected with the first set of DC terminals and operative to provide a second DC voltage at a second set of DC terminals; the second set of DC terminals being electrically isolated from the power line terminals;

inverter ballasting means connected with the second set of DC terminals and operative to provide a current-limited high-frequency output voltage at a set of ballast output terminals; and gas discharge lamp means connected with the ballast output terminals and operative to be properly started and powered from the current-limited high-frequency output voltage provided thereat.

18. The arrangement of claim wherein:

(i) the DC-to-DC converter means includes a transistor means having a control input and being functional, in response to receiving an AC control signal at its control input, to alternate between a state of conduction and a state of non-conduction; and (ii) the inverter ballasting means has an auxiliary output connected in circuit with the control input and operable to provide said AC control signal.

* * * * *